United States Patent [19]

Hammond

[11] Patent Number: 4,793,612

[45] Date of Patent: Dec. 27, 1988

[54] APPARATUS FOR PRACTICING AND TEACHING BALL BATTING

[76] Inventor: Robert G. Hammond, 25572 Orchard Rim La., El Toro, Calif. 92630

[21] Appl. No.: 19,208

[22] Filed: Feb. 26, 1987

[51] Int. Cl.[4] ..... A63D 15/10

[52] U.S. Cl. ..... 273/26 E; 273/58 C

[58] Field of Search ..... 273/26 E, 29 A, 184 B, 273/185 C, 186 R, 58 C; 272/78, 65; 248/200, 251

[56] References Cited

U.S. PATENT DOCUMENTS

| | | | |
|---|---|---|---|
| 2,305,187 | 12/1942 | Neiden | 273/29 A |
| 2,976,040 | 3/1961 | Bales | 273/26 E |
| 3,006,647 | 10/1961 | Haskett | 273/26 E |
| 3,397,885 | 8/1968 | Nash, Jr. | 273/26 E |
| 3,934,873 | 1/1976 | Griffin | 273/26 E |
| 4,350,338 | 9/1982 | May | 273/58 C |

*Primary Examiner*—Richard C. Pinkham
*Assistant Examiner*—T. Brown
*Attorney, Agent, or Firm*—Stetina and Brunda

[57] ABSTRACT

Apparatus for practicing and teaching ball batting characterized by use of a rotary member journaled for rotation about a shaft, and a flexible linkage affixes a ball, nominally a baseball, in a down-hanging position from the rotary member. When the ball is struck with a bat it will move in an arcuate motion about the axis of the rotary member. Particularly in accordance with the present invention, a backboard mounts the rotary member to a vertrical post. The backboard is releasably maintained upon the post by "U" bolts which hold the post against a channel formed by spaced-apart parallel spacer bars positioned upon the backboard. The flexible linkage incorporates a spring-biased hook allowing ready substitution of balls thereon.

4 Claims, 2 Drawing Sheets

11
10
12
13
23
26
21
20
27
32
24
22
C
34
25
30
35
25
70
13
36
40
5
5
11
14
10
13
21
22
26
20
24
23
27
25
31
32
25
33
34
61
30
14
13
35
36
31
33
34
35

Fig. 5
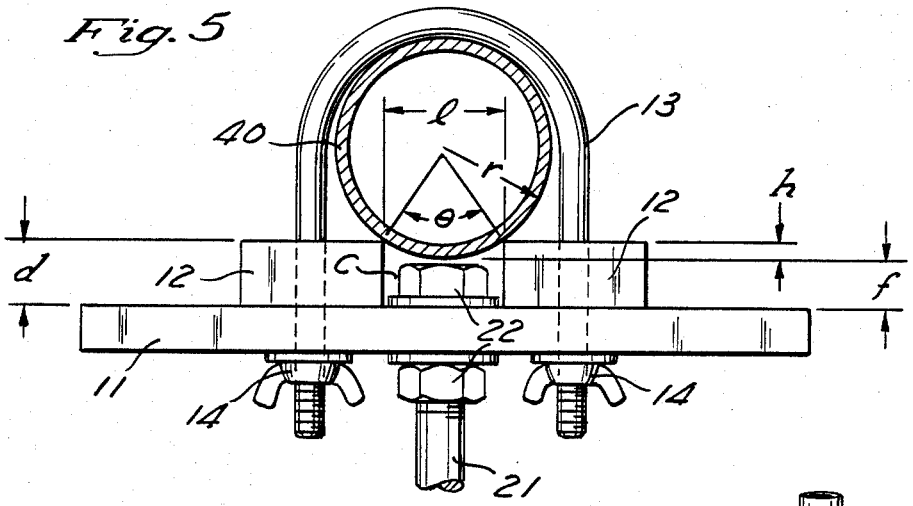
Fig. 4
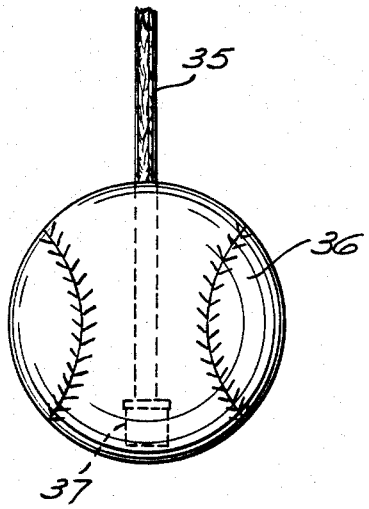
Fig. 6
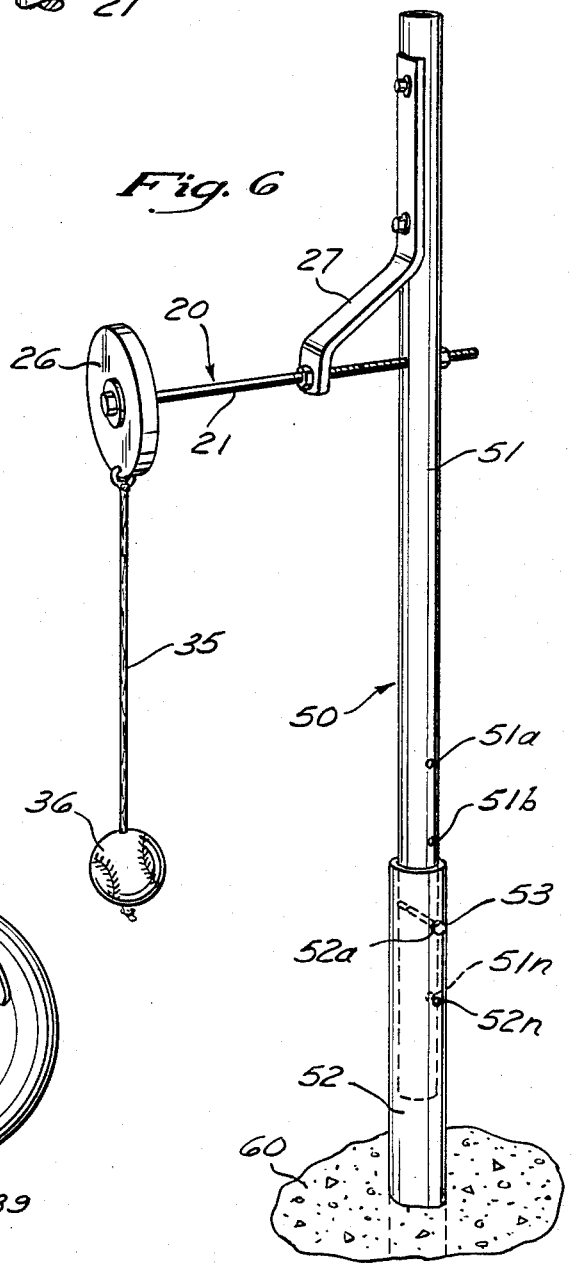
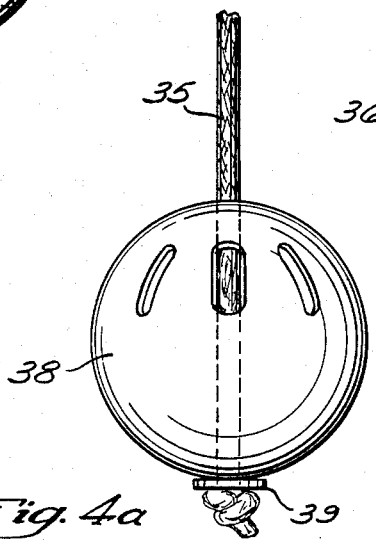
Fig. 4a

APPARATUS FOR PRACTICING AND TEACHING BALL BATTING

BACKGROUND OF THE INVENTION

1. Field of the Invention

The present invention concerns an apparatus for practicing and teaching the batting of balls, particularly baseballs.

2. Description of the Relevant Art

Many games including the game of baseball require that a ball be skillfully hit with a bat, or stick. It is known to provide mechanical apparatus i.e. pitching machines which assist in the delivery, and redelivery, of baseballs to a batter in a manner which permits a batter to practice, and a hitting instructor to teach proper batting. Unfortunately such prior art pitching machines are extremely costly and area intensive and therefore are typically only utilized in the commercial setting.

More recently, the prior art has developed an indoor-outdoor, free-standing, platform apparatus particularly directed to the practicing and teaching of baseball hitting. Such a free-standing apparatus may be initially erected upon the floor and subsequently be utilized in its semi-permanent location. The apparatus essentially consists of (i) a generally vertical support member and base platform which supports and mounts a rotary arm member, (ii) a generally horizontal rotary arm member which suspends an impact member for arcuate motion about a vertical axis, and (iii) a free-hanging suspended impact member which may be struck by a bat for arcuate motion about the rotary arm member.

In this prior art device the vertical support member comprises a vertical column, or post, which is several feet high, which is supported by a base, and from which column perpendicularly extends a horizontal arm. The horizontal arm serves as an axis to a rotatable wheel mounted thereon at a few feet separation from the post. The horizontal arm and its wheel are the basic parts of the rotary arm member. The rotatable wheel, normally several inches in diameter, connects at a point upon its circumference to a flexible rope linkage, normally several feet long, which extends in a radial direction downwards from the horizontal arm and the wheel. At the end of the rope linkage a baseball is affixed. The rope linkage and its attached ball are parts of the suspended impact member.

In its static position, the rope linkage hangs vertically from the wheel and suspends the ball in air at a separation from both the horizontal arm and vertical column, and at a height and position suitable to be struck with a bat. When the ball is struck with a bat, it travels in an arcuate motion defined by the radius of the rope linkage about the axis of the wheel. If the ball is batted well and fully, it will completely encircle the horizontal arm on the rope linkage and will ultimately return, under the force of gravity, to the quiescent down-hanging static position. Thus the suspended ball is consistently used, and reused, in the practicing and teaching of ball batting.

The improvements of the present invention require that particular attention be given to certain elements of such prior art apparatus. The vertical post which supports and mounts the horizontal arm which suspends the ball by the linkage is, in the prior art, freestanding. The foundation to this freestanding vertical post comprises a base platform which is erected upon the floor or ground by several, generally orthogonal, intersecting steel rod elements. At a point of the intersection of several of the rod elements defining the base platform, the vertical post is affixed, either by mechanical fasteners or by welding. The vertical support post may be aided in retaining its vertical position perpendicular to the base platform by one or more support arms which extend angularly downward from the vertical post to the rod members upon the base platform. The support post does not penetrate below its foundation base platform, nor into the floor or ground.

As such, this more recently introduced prior art device has proven to be costly, difficult to transport and erect and thereby has proven generally unsuitable for widespread use.

SUMMARY OF THE INVENTION

The present invention specifically addresses and alleviates the above-referenced difficiencies associated in the prior art and comprises an improvement to apparatus for practicing and/or teaching ball batting. More particularly the present invention comprises a readily portable batting apparatus having (i) a generally vertical support member which supports and mounts a rotary arm member, (ii) a generally horizontal rotary arm member adapted to be readily mounted to a support surface which suspends an impact member for arcuate motion in a vertical plane, and (iii) a free-hanging suspended impact member which may be struck by a bat for arcuate motion about the rotary arm member.

In the improved apparatus of the present invention, the vertical support member includes a backboard which is itself mountable to a vertical surface, post, or to a chain link fence post, at a selectable height thereupon. The backboard is particularly mountable at such a selected height by reusable fasteners, nominally bolts which ridgidly affix the backboard to a vertical surface or post or chain link fence post. Particularly for affixation to a post, the backboard also includes a self-centering and aligning member which directly contacts the post in order to simultaneously (i) center and (ii) align the backboard to a vertical support post mounted thereto. The centering and aligning member particularly consist of two parallel guide bars spaced from one another which form, in conjunction with the backboard, a channel to tangentially contact the circumference of the vertical support post. As such the present invention is light weight, readily portable, and rapidly mountable to various support surfaces thereby being capable of widespread commercial as well as recreational use.

In an alternative embodiment, the improved apparatus of the present invention includes a vertical support member formed in two sections, with the lower section being permanently affixed in the ground and the upper section attaching to the first section at selectable heights, normally through the mechanism of an axial slip joint between two tubular sections.

Finally, in the improved apparatus of the present invention the suspended impact member includes elements with improved interoperability. More particularly, the ball member includes a through-bore through its central axis which captures a ferrule within an enlarged diameter end portion of the through-bore. A rope member passing through the through-bore is, at one end, retained within the ferrule and at the other end is provided with a loop or eyelet. This eyelet is readily selectively coupled to a spring-biased hook fastener which is attached to the rotary arm member. The suspended impact member so constructued is durable and responsive in operation. Furthermore, it allows eady interchange of the rope member and the ball affixed thereto for ready adjustment of ball weights and diameters, and of the variable heights at which balls are suspended upon the apparatus.

These as well as other features of the present invention will become more apparent upon reference to the drawings wherein:

BRIEF DESCRIPTION OF THE DRAWINGS

FIG. 4 and FIG. 4*a* are detailed views showing alternative attachments between the ball member and rope member of the apparatus of the present invention.

FIG. 5 is a cross-sectional view, taken along aspect line 5—5 shown in FIG. 1, showing the mounting of the backboard member to a support post.

FIG. 6 is a perspective view showing a second variant embodiment of the apparatus of the present invention wherein the rotary arm member may be mounted upon a pair of telescoping tubular members.

DESCRIPTION OF THE PREFERRED EMBODIMENT

Figures 1, 2, 3:
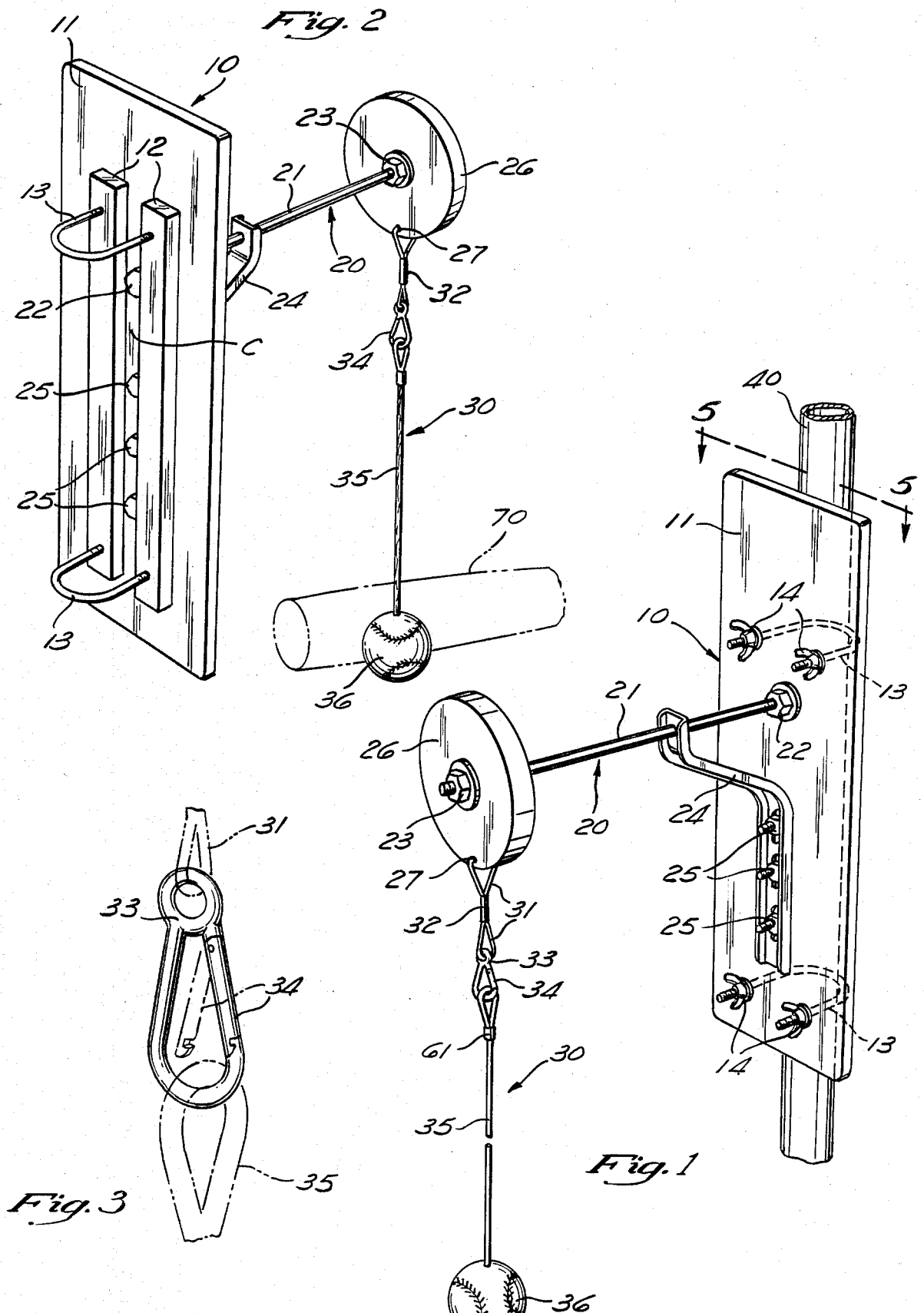
FIG. 1 is a front perspective view showing a first variant embodiment of the apparatus of the present invention.
FIG. 2 is a rear perspective view thereof showing the same first variant embodiment of the apparatus of the present invention.
FIG. 3 is a detailed view showing the spring-biased hook member.

The present invention is an improvement to a portable, indoor-outdoor, all-season apparatus for practicing and for teaching the hitting of balls with bats, particularly the hitting of baseballs with baseball bats. The apparatus may be used by both the right- and left-handed hitters. The practice and teaching conducted with the apparatus is intended to improve eye and hand coordination, body extension, proper stride, and consistency in batting.

A first variant embodiment of the improved apparatus in accordance with the present invention is generally shown in FIGS. 1–5. The apparatus generally includes a planar support member 10 for supporting and mounting an elongate generally horizontal extending rotary arm member 20. The rotary arm member 20 suspends an impact member 30 for arcuate, rotary, motion about the axis of the arm member 20. The impact member 30 may be struck by a bat 70 (illustrated by phantom lines in FIG. 1), particularly at the ball member 36 thereof, in order to induce arcuate motion about the rotary arm member 20.

The support member 10, observable in front and rear perspective views respectively in FIGS. 1 and 2, includes a backboard 11, preferably formed from wood, plastic or, Plexiglas and preferably sized to have dimensions of 23″×8″×⅜″. The backboard 11 may be imprinted with suitable legends, graphics, and/or instructions (not illustrated) to instruct a user as to proper use and mounting of the same unto a support surface. On the rear side of the backboard 11, the backboard includes a pair of guide members 12. The guide members 12 comprises elongate parallel bars which are spaced from one another through a short distance (i.e. 1½ to 2 inches) to define a central channel "C" therebetween which channel "C" is preferably 16″ in length and ⅜″ deep.

A pair of fasteners 13 preferably "U"-bolts, extend through the backboard 11 and guide members 12 and are releasably secured at the front face of backboard 11 by mating threaded fasteners 14 and particularly wing nuts. As will be explained in more detail infra, the fasteners 13 and guide members 12 permit rapid mounting of the backboard 11 to a vertical support post, such as a fence post.

Continuing with the description of the first variant embodiment of the present invention, the rotary arm member 20 is best observable in FIG. 1 and FIG. 2. This member 20 includes a generally horizontal elongate shaft 21, normally ½″ diameter steel rod, which is ridgidly secured to backboard 11 by mounting hardware 22, 23 normally a pair of threaded fasteners and washers. The point of attachment of shaft 21 to backboard 11 is preferably midway across the width of the backboard 11 such that the mounting hardware 23 which appears at the rear side of backboard 11 is received within the channel "C" formed between the guide members 12. The shaft 21 is further supported in its horizontal position by a mounting bracket 24 which comprises a generally L-shaped leg member which cooperates with the shaft 21 through an aperture at one end and extends angularly downward therefrom to be fastened to backboard 11 by plural fasteners 25. As with to the point of affixation of shaft 21 to backboard 11, the mounting bracket 24 and its fasteners 25, normally threaded fasteners are centrally located along the width of backboard 11 such that the portion of mounting fasteners 25 which appear at the rear side of backboard 11 is received within the channel "C" defined by guide members 12. As will be recognized this construction provides good stability in maintaining the fixed interrelationships of components while minimizing stress on such components, including specifically the backboard 11.

The shaft 21 of the rotary arm member 20 shown in FIG. 1 and FIG. 2, mounts at its distal end a rotary disc, or wheel, 26. The distance of wheel 26 from backboard 11 is nominally 13″, however can be varied to accomodate the size of a user. This wheel 26 is journaled for low friction rotation, which may be aided by ball or roller bearings, about shaft 21. Wheel 26 is normally 6″ in diameter and is retained upon the shaft 21 by mounting hardware 23, normally nuts and washers on both sides of its central hub. The wheel 26 includes at a point along its rim a transverse through-bore or aperture 27.

The suspended impact member 30 is permanently connected to the wheel 26 by a flexible retaining member 31 which is in shape of a closed loop. A first end of the member 31 extends through the aperature 27 while the opposite end, extends through a ring formed within a spring-biased hook member 33. The retaining member 31 is normally made of steel cable, or the like, which is permanently retained in the illustrated shape by a crimp connector compressive fitting 32.

The spring-biased hook member 33 is shown in expanded detail in FIG. 3. The hook member 33 is nominally 2.5″ long and includes a movable spring-loaded bridging or gate element 34 which may be temporarily displaced, as illustrated in phantom lines, to releasably engage a rope member 35. When the spring-biased gate element 34 is in its normal, closed position as illustrated in solid lines, the rope member 35, and the ball member 36 affixed thereto, are securely maintained engaged within hook member 33. When it is desired to substitute a particular rope member 35 and an associated ball member 36 affixed thereto, then the eyelet of the rope member 35 may be readily slipped from engagement with spring-biased hook member 33 by temporarily opening spring-loaded gate element 34.

As shown, the rope member 35 presents at its upper terminus a loop (best observable in FIGS. 1–3) which is engageable with the spring-biased hook member 33. The loop may be formed by doubling over the end of the rope member 35 back upon itself and permanently securing the end in such a doubled-back position by a connector 61, normally a crimp-fit steel compressive fitting.

The details of affixation of the rope member 35 to the ball member 36 are particularly illustrated in FIGS. 4 and FIG. 4*a*. The ball member 36 shown in FIGS. 1, 2, and 4 normally exhibits several ounces of mass and is nominally a regulation baseball. The preferred manner of affixing the rope member 35 to the ball member 36 is to create an axial through-bore completely through such baseball. The through-bore is fitted with a ferrule end connector within an enlarged diameter end portion of the through-bore. The cord member 35 extends axially through the bore and is then knotted or otherwise enlarged (such as by having a crimp fitting affixed) at its end located beyond ferrule 37. The rope member 35 is then pulled snuggly back through the through-bore of ball member 36 causing its enlarged end to become lodged within the through-bore. In such a frictionally retained position, the ball 36 will not move along the length of rope member 35 in either direction, but will remain retained at the end of rope member 35. The rope member 35 is nominally 16" in length, and the length of the entire suspended impacted member 30 is nominally about 22". This length may be varied, primarily by adjustment of the length of rope member 35, in order to position the ball 36 at an appropriate height for various batters.

An alternative affixation of the ball member which is particularly suitable for a low-weight plastic ball such as a WIFFLE TM hollow plastic ball 38 is illustrated in FIG. 4*a*. The hollow plastic ball 38 does not possess any solid internal mass which will support the drilling of a bore or the mounting of a ferrule. Consequently, the rope 35 is threaded through oppositely disposed holes within the shell of hollow ball 38 and then through a hole of a washer 39. Then the end of rope member 35 is tied in a knot which will not slip the hole of washer 39. Thereby the hollow plastic ball 38 is affixed to cord member 35.

The manner of use of the improved apparatus of the present invention which incorporates a support member 10 which particularly includes a backboard 11 is illustrated in cross-section view, taken along line 5—5 of FIG. 1, in FIG. 5. As will be recognized from the above description the apparatus of the present invention due to its size and construction may be readily transported by a user to a desired location for use. In this regard when desired, the backboard 11 may be rapidly rigidly affixed to a vertical support surface such as a wall merely by replacing the "U"-shaped fasteners 13 with conventional wood screws or the like extending into the support surface. However, when desired to mount the backboard 11 to a vertical post for instance a chain link fence post, the backboard 11 may be positioned to contact a vertical post 40 (not part of the present invention) by the reuseable fasteners 13, normally "U"-bolts which surround or straddle the vertical post 40, and extend through the backboard 11 to be rapidly secured to backboard 11 by fasteners 14, normally wing-nuts. More particularly, the post 40 may be observed in FIG. 5 to directly contact the backboard 11 at and along the edges of the parallel guide members 12 which are affixed to backboard 11. By this mounting, i.e. tangential contact of the guide member 12 with the circumference of the post 40, the post 40 will be both self-centered, registered and aligned to the backboard 11.

Continuing in FIG. 5, the post 40 is affixed in a position running parallel to the channel "C" between the guide members, or spacer bars, 12. As such an arcuate segment of angle $\theta$ (theta) and radius r of such post 40 will be directly subtended. This arcuate segment of angle $\theta$ and radius r exhibits a cord to angle $\theta$ of length 1, and a rise to such cord of height h. By standard geometrical relationships for circles, it may be recognized that:

$$h=r-\sqrt{r^2-l^2/4}$$

wherein $$l=2r\sin\theta/2$$

In the diagram of FIG. 5, it may observed that the combined thickness of the shaft 21 and its mounting hardware 22 on that side of backboard which is proximal the post 40 is defined as thickness f. The thickness of the guide members, or spacer bars, 12 is defined as thickness d. In order for optimal operation of the invention, the following relationship must hold:

$$d\geqq h+b$$

Substituting a geometrical relationship defining h, the preferred geometry of the present invention will be obtained when:

$$d\geqq h+b=4-(\sqrt{r^2-l^2/4})+b$$

The fasteners, normally "U"-bolts, and mating fasteners 14, normally wing-nuts, which normally affix the backboard 11 to the post 40 may, alternatively, affix such backboard to any suitable surface, including a rectangular fence post. When so affixed, the standoff distance d created by spacer bars 12 serves as a purchase to the "U"-bolts. However, the spacer bars 12 no longer serve as a self-centering aligning member as was obtained during mounting to a cylindrical of post 40.

A second variant embodiment of the apparatus of the present invention is shown in FIG. 6. The generally vertical composite support member 50 shown therein may be observed to particularly include an upper vertical mounting member 31 supporting and mounting the rotary arm member 20. This upper vertical mounting member 31 is removably attached to a lower mounting member 52 which may be permanently affixed within the ground. Both the upper vertical mounting member 51 and the lower vertical mounting member 52 are preferably formed as hollow tubes which telescopingly mate with each other along the interior and exterior diameters respectively. The upper vertical mounting member 51 presents oppositely disposed radially extending apertures 51*a–n* within its lower wall surfaces, whereas the lower mounting member 52 presents like oppositely disposed apertures 51*a–n* within its upper wall surfaces. When the two tubular members are telescoped relative one another, the apertures 51*a–n* become aligned with counterpart selected ones of aperture 52*a–n*. When the apertures are appropriately aligned so as to establish the desired height of support member 50, then a retaining member 53, normally a threaded fastener, may be inserted through the aligned apertures of both the upper vertical mounting member 51 and the lower vertical mounting member 52. The lower vertical mounting member 52 may optionally be removably maintained in a subterranian concrete base or footing 60, as well as directly within ground soil. It may additionally be observed in FIG. 6 that the orientation of mounting bracket 27 has been reversed without moderation in its function or effect.

The second variant embodiment apparatus of the present invention shown in FIG. 6 is particularly useful of employment in schools, parks, public fields, or other areas where repeated use of the device is contemplated and damage or theft of an unattended baseball batting practicing or teaching apparatus might be countenanced. Within such an environment of use, the lower mounting member 52 is permanently affixed into the ground or into a concrete mounting pad. Upon such time it is desired to assemble and use the baseball batting practicing and/or teaching apparatus, the other elements of the apparatus are rapidly transported to the lower mounting member 52 and assembled thereon.

In accordance with the preceding description, the present invention will be seen to encompass certain improvements particularly directed to (i) the support member and/or to (ii) the suspended impact member of a ball batting practicing and/or teaching apparatus. Certain variations in the present apparatus will be obvious to a routineer in the design of mechanical equipments used in ball sports. For example, the upper vertical mounting member of the second variant embodiment of the present invention could be integral with the rotary arm member and could serve to cap a lower vertical mounting member which is permanently affixed within the ground. For example, the spring-biased hook-member could be directly affixed to the preferable rim of a disc or wheel, without an intervening connective element. In accordance with such possible variations, the present invention should be interpreted broadly in accordance with the language of the following claims only, and not soley in the context of those particular embodiments within which the present invention has been taught.

What is claimed is:

1. An apparatus for practicing ball batting comprising:

a backboard having a front and rear surface;

an arm member mounted to said backboard and extending generally perpendicularly outward from said front surface;

an impact member suspended from said arm member to rotate about the longitudinal axis of said arm member upon being struck by a bat;

means positioned on the rear surface of said backboard and extending therethrough to said front surface of said backboard for mounting said backboard to a vertical support post; and a pair of elongate spacer bars mounted to the rear surface of said backboard extending in a plane generally parallel to the plane of said backboard, said pair of spacer bars being laterally spaced from one another to define a channel therebetween and a pair of parallel rear abutment surfaces, said channel being adapted to support said backboard substantially parallel with the longitudinal axis of the support post.

2. The apparatus for practicing ball batting according to claim 1 wherein said mounting means comprises:

"U"-bolts extending through said backboard.

3. The apparatus for practicing ball batting according to claim 2, wherein said suspended impact member comprises:

a ball defining a through-bore through its center and mounting a ferrule within a bore at an enlarged-diameter end-portion thereof;

a first rope member with a one end passing through the through-bore terminating in an enlarged-diameter end-portion permanently retained within the ferrule, and with another end forming an eyelet;

a spring biased hook member selectively engaging the eyelet; and a fastener member permanently engaging the hook member and the arm member.

4. The apparatus for practicing ball batting according to claim 3 further comprising:

a support arm extending angularly from the front surface of the backboard to the arm member to mechanically support the arm member substantially perpendicular to the plane of the backboard.

* * * * *